US011098896B2

(12) United States Patent
Johansson et al.

(10) Patent No.: US 11,098,896 B2
(45) Date of Patent: Aug. 24, 2021

(54) BURNER WITH FUEL AND AIR SUPPLY INCORPORATED IN A WALL OF THE BURNER

(71) Applicant: Siemens Aktiengesellschaft, Munich (DE)

(72) Inventors: Nicklas Johansson, Skarblacka (SE); Jenny Larfeldt, Finspang (SE); Jan-Erik Lundgren, Svartinge (SE); Daniel Moell, Finspang (SE); Erik Munktell, Finspang (SE)

(73) Assignee: Siemens Energy Global GmbH & Co. KG, Munich (DE)

( * ) Notice: Subject to any disclaimer, the term of this patent is extended or adjusted under 35 U.S.C. 154(b) by 246 days.

(21) Appl. No.: 16/319,914

(22) PCT Filed: Aug. 18, 2017

(86) PCT No.: PCT/EP2017/070936
§ 371 (c)(1),
(2) Date: Jan. 23, 2019

(87) PCT Pub. No.: WO2018/041647
PCT Pub. Date: Mar. 8, 2018

(65) Prior Publication Data

US 2019/0264913 A1 Aug. 29, 2019

(30) Foreign Application Priority Data

Aug. 31, 2016 (EP) ..... 16186587

(51) Int. Cl.
*F23D 14/78* (2006.01)
*F23R 3/14* (2006.01)
(Continued)

(52) U.S. Cl.
CPC ..... *F23D 14/78* (2013.01); *F23R 3/14* (2013.01); *F23R 3/286* (2013.01); *F23R 3/343* (2013.01);
(Continued)

(58) Field of Classification Search
CPC .. F23C 2900/07002; F23C 2900/03041; F23C 2900/42
See application file for complete search history.

(56) References Cited

U.S. PATENT DOCUMENTS 4,041,699 A * 8/1977 Schelp ..... F02C 7/16 60/39.55
6,210,152 B1 4/2001 Haffner et al.
(Continued)

FOREIGN PATENT DOCUMENTS

CN 204943566 U 1/2016
EP 2650612 A1 10/2013
EP 3059500 A1 8/2016

OTHER PUBLICATIONS

PCT International Search Report and Written Opinion of International Searching Authority dated Nov. 21, 2018 corresponding to PCT International Application No. PCT/EP2017/070936 filed Aug. 18, 2017.
(Continued)

*Primary Examiner* — Steven M Sutherland
*Assistant Examiner* — Rodolphe Andre Chabreyrie

(57) ABSTRACT

A burner of a turbomachine has an upstream burner section providing a first fuel and an oxygen containing fluid to an upstream end of a burner interior, a downstream burner section for providing a second fuel to a downstream end of the burner interior, and an intermediate burner section between the two sections. The intermediate burner section has an annular wall surrounding a mid-section of the burner interior. The annular wall has an annular cooling fluid
(Continued)

passage, for guiding the oxygen containing fluid, and an annular fuel passage for guiding the second fuel to the downstream burner section, the annular fuel passage being more distant to the burner interior than the annular cooling fluid passage. Two annular slots are incorporated into the annular wall. The upstream burner section has at least one integrated fuel tube through a body of the upstream burner section, configured to feed the annular fuel passage.

19 Claims, 8 Drawing Sheets

(51) Int. Cl.
*F23R 3/34* (2006.01)
*F23R 3/36* (2006.01)
*F23R 3/28* (2006.01)

(52) U.S. Cl.
CPC ..... *F23R 3/36* (2013.01); *F23C 2203/00* (2013.01); *F23C 2203/30* (2013.01); *F23C 2900/07002* (2013.01); *F23R 2900/00004* (2013.01); *F23R 2900/03041* (2013.01); *F23R 2900/03042* (2013.01)

(56) References Cited

U.S. PATENT DOCUMENTS 9,103,547 B2 * 8/2015 Eroglu ..... F23C 7/002
2007/0259296 A1 * 11/2007 Knoepfel ..... F23D 17/002 431/9
2009/0081599 A1 * 3/2009 Bernero ..... F23C 7/008 431/159
2009/0255102 A1 * 10/2009 McMasters ..... F23R 3/14 29/402.18
2010/0071376 A1 * 3/2010 Wiebe ..... F23R 3/60 60/740
2010/0170255 A1 * 7/2010 Zuo ..... F23R 3/286 60/748
2010/0293954 A1 11/2010 Widener
2012/0036855 A1 * 2/2012 Hull ..... F23R 3/343 60/737
2012/0291439 A1 * 11/2012 Oskam ..... F23R 3/286 60/737
2014/0311150 A1 * 10/2014 Pinson ..... F23R 3/14 60/737
2015/0047313 A1 * 2/2015 Maurer ..... F23R 3/04 60/39.48
2015/0082796 A1 * 3/2015 Andersson ..... F23R 3/34 60/746
2015/0285502 A1 10/2015 DiCintio et al.
2016/0245182 A1 * 8/2016 Elwasila ..... F23R 3/346
2018/0058697 A1 3/2018 Ofverstedt

OTHER PUBLICATIONS

EP search report dated Jun. 2, 2017, for corresponding EP patent application No. 16186587.8.

* cited by examiner

V-V

BURNER WITH FUEL AND AIR SUPPLY INCORPORATED IN A WALL OF THE BURNER

CROSS REFERENCE TO RELATED APPLICATIONS

This application is the US National Stage of International Application No. PCT/EP2017/070936 filed Aug. 18, 2017, and claims the benefit thereof. The International Application claims the benefit of European Application No. EP16186587 filed Aug. 31, 2016. All of the applications are incorporated by reference herein in their entirety.

FIELD OF INVENTION

The present invention relates to a burner, a combustor of a turbomachine, particularly a gas turbine engine, a method of operating such a burner, and a method of manufacturing.

BACKGROUND OF THE INVENTION

Gas turbine engines, as one example of turbomachine, comprise as main components a compressor, a combustor, and an expansion turbine. For combustors, different designs exist, for example annular combustors or can-annular combustors. The combustor itself is comprised of a burner via which fuel is provided to a combustion space and a combustion chamber to encapsulate the combustion space. The combustion space is also provided with oxygen containing fluid for combustion, particularly air provided from the compressor.

Burners can be supplied with different kinds of fuel. Some burners may even be designed to be operated—alternating or in parallel—with two types of fuels, particularly gaseous fuel and liquid fuel.

Additionally, burners may be designed to operate under lean conditions so that the emissions, particularly NOx and CO is kept low. Under lean condition a mix of fuel and air is considered in which all or most of the fuel is burnt. For such a lean operation typically so-called main fuel is provided. For transient operation, for example during start-up of the turbomachine, additional fuel may be provided as so-called pilot fuel to stabilise the flame and to avoid combustion dynamics.

Typically the injection points within the burner differ between main fuel and pilot fuel, in some cases even different types of fuel is provided as main and pilot fuel. Therefore fuel pipes may be present at the outside of the burner to provide the main and pilot fuel to their respective fuel injection points.

A burner of a gas turbine engine is mostly surrounded by air provided via an inlet to the compressor. Past the compressor, ignoring intermediate passages and cavities, the air can be delivered as compressed air to an interior of the burner, e.g. by guiding the air through slots between swirler vanes as part of the burner or being attached to the burner. These swirler vanes generate a swirling flow of the air, into which the main fuel is typically injected for good mixing of fuel and air.

The surrounding air around the burner may, as a secondary effect, also support to cool the mentioned fuel pipes at the exterior of the burner. On the other hand these fuel pipes may disturb the air flow.

Besides the mentioned fuel supply and the mentioned swirler, means may be present to provide cooling of hot walls, like walls of the burner or of the combustion chamber.

Typically, the cooling is performed by guiding the compressed air to specific regions of the burner and the combustion chamber, by using principles like film cooling, effusion cooling, or impingement cooling.

If cooling is not sufficient during some modes of operation, liquid fuel may cause coking of hot walls that are not sufficiently cooled. If not sufficiently cooled, coking can also happen within fuel supply pipes.

All the mentioned features of the burner lead in consequence to a noticeable manufacturing and assembly time, for example if a number of burner components need to be assembled to build the overall burner.

A specific burner design, which may be discussed later in more detail, is known from EP 2 650 612 A1, U.S. Pat. No. 6,210,152 B1, or EP 3 059 500 A1 in which a swirler section is followed by a mixing section, and again followed by an outlet section, which in turn is connected to a main combustion zone. Main fuel may be provided in the swirler section, while pilot fuel may be provided in the outlet section.

SUMMARY OF THE INVENTION

The present invention seeks to mitigate these drawbacks.

This objective is achieved by the independent claims. The dependent claims describe advantageous developments and modifications of the invention.

In accordance with the invention there is provided a burner of a turbomachine, particularly a gas turbine engine, comprising an upstream burner section, an intermediate burner section, and a downstream burner section. The upstream burner section is arranged to provide a first fuel—typically so called main fuel, gaseous or liquid—and an oxygen containing fluid—typically air—to an upstream end of a burner interior. The burner interior is substantially a hollow space in which a mixing of fuel and the oxygen containing fluid can take place. The downstream burner section is arranged to provide a second fuel—typically so called pilot fuel, advantageously in gaseous form—to a downstream end of the burner interior or to a combustion chamber, which usually is located downstream of the burner. The intermediate burner section is located between the upstream and the downstream burner section and typically defines a mixing zone for further mixing the first fuel and the oxygen containing fluid. The intermediate burner section could also be called a mixer. The intermediate burner section comprises an annular, advantageously cylindrical, wall surrounding a mid section of the burner interior. The annular wall, in turn, comprises an annular cooling fluid passage—or fluid slot—, particularly for guiding the oxygen containing fluid, and an annular fuel passage—fuel slot—for guiding the second fuel to the downstream burner section, the annular fuel passage being more distant to the burner interior than the annular cooling fluid passage. Further, the upstream burner section comprises at least one integrated fuel tube through a body of the upstream burner section, that is configured to feed the annular fuel passage.

By this configuration the annular wall comprises three concentric walls separated by the annular cooling fluid passage and the annular fuel passage. The annular cooling fluid passage cools the annular wall and/or acts as a heat shield for the annular fuel passage.

By having an annular configuration of the annular fuel passage the distribution of fuel around the circumference is even. Also the annular cooling fluid passage allows an even distribution of cooling fluid. Both of these features avoid local hot spots.

As said, the upstream burner section comprises at least one integrated fuel tube through a body of the upstream burner section, that is configured to feed the annular fuel passage. This allows to integrate all fuel feeding features within the body or walls of the burner. No external piping is needed would need to be connected to the burner exterior.

The terms "upstream"/"downstream"/"mid(stream)" are used to indicate a direction along a burner axis and are relative to a fuel flow direction. Even though some fluids will be swirled, in the end a main travel direction can be given from an upstream end of the burner to the exit (downstream end) of the burner. The exit will release the fluid into the combustion chamber, which will therefore be again be downstream of the burner.

The term "interior" and "exterior" is used in respect of a radial direction of the burner, assuming an axis of a burner can be defined to which the radial direction is perpendicular. A radial inwards cavity—the burner interior—is surrounded radially outwards by the annular wall. Beyond that annular wall, i.e. further radially outwards, a burner exterior is defined. The burner exterior is supposed to be a hollow space to guide compressed oxygen containing fluid provided from a compressor of the turbomachine.

In an embodiment the annular wall may further comprise a plurality of film cooling holes that pierce the annular wall from an exterior of the burner to the mid section of the burner interior, the film cooling holes piercing the annular cooling fluid passage and piercing the annular fuel passage but being fluidically separate—i.e. without connection—from the annular cooling fluid passage and from the annular fuel passage. This allows film cooling of an interior surface of the annular wall. The fluid for film cooling may be advantageously the oxygen containing fluid, i.e. air.

In a further embodiment the annular wall may further comprise at least one cooling fluid inlet hole providing the annular cooling fluid passage with cooling fluid—i.e. the surrounding oxygen containing fluid or compressed air which can be used for cooling—from an exterior of the burner, the cooling fluid inlet hole piercing the annular fuel passage but being fluidically separate from the annular fuel passage. So a local barrier is present around the cooling fluid inlet hole so that this inlet hole is sealed against the annular fuel passage. No fluidic connection is present between the annular fuel passage and the cooling fluid inlet hole.

In yet another embodiment, the annular wall may further comprise a plurality of effusion holes—i.e. effusion cooling holes—for ejecting cooling fluid from the annular cooling fluid passage to the mid region of the interior of the burner, wherein advantageously the effusion holes are distributed around a circumference and along an axial length of the intermediate burner section. Effusion holes pattern may vary in either direction or may stay evenly distributed. The effusion holes provide cooling of the inner surface of the annular wall.

In an embodiment the annular cooling fluid passage and the annular fuel passage each may be defined as a slot with an expansion along a complete axial length of the intermediate burner section, i.e. expanding from the upstream burner section up to the downstream burner section. This allows to define an act as a cooling shield for the whole intermediate burner section.

In a further embodiment the annular wall further comprises spacer elements within the annular cooling fluid passage and/or the annular fuel passage, wherein the spacer elements may be physically connected to—only—one surface and may be only in loose contact with an opposite surface of the respective annular passage. The spacer element may be formed as a distance bump, particularly in form of a hemisphere or a semi-cylinder. The semi cylinder may have an expanse of the cylinder in axial direction. "Loose contact" defines that the passage is free of struts that otherwise could solidly connect the two opposing surfaces. Thus, the spacer element only touches the opposite surface via a bearing contact, but is not fixedly connected.

Advantageously, the annular wall may be an integrally formed component, joined with the upstream burner section and the downstream burner section. Alternatively, the upstream burner section, the intermediate burner section and the downstream burner section may be—altogether—, an integrally formed component, so in consequence the complete burner may be integrally formed. "Integrally formed" shall mean that the component is monolithic, i.e. manufactured in one single manufacturing process as a single piece, without having a subsequent joining step. So the burner may be a single piece. In other words, the components of the burner are fully integrated with another.

To use additive manufacturing allows to create complex and fine structures, like the three wall configuration or embedding the mentioned cooling features into the burner and the annular wall.

The burner may comprise further components not yet introduced. Particularly the upstream burner section may comprise a plurality of swirler vanes, each of the swirler vanes advantageously providing an integrated fuel tube—particularly for guiding pilot fuel—, that is configured to feed the annular fuel passage.

Also, a main fuel supply may be integrated in the burner body. For example the plurality of swirler vanes each may comprise an integrated further fuel supply line, the further fuel supply line—particularly for main fuel—being configured for feeding first fuel nozzles to eject the first fuel into the upstream end of a burner interior, the first fuel nozzles advantageously being distributed on a surface of the swirler vane.

The upstream burner section may provide a swirler and first fuel nozzles for swirling air and injecting the first fuel—particularly the main fuel—into the swirled air, the intermediate burner section may provide a pre-mixing zone for mixing the air and the injected first fuel, and the downstream burner section may provide a burner tip and second fuel nozzles for ejecting the second fuel—usually the pilot fuel.

Furthermore, the invention is related to a combustor, comprising a plurality of burners as explained before and at least one combustion chamber, particularly an annular or a can-annular combustion chamber, arranged downstream of the burner(s). Can-annular is a configuration in which one burner and one combustion chamber form a pair and several of these pairs are arranged annularly about an axis of the turbomachine.

So far the focus has not been on the fuel supply to the burner. In an embodiment of the invention a burner shaft may be attached to the upstream burner section and may comprise at least one supply channel for providing the first fuel and/or the second fuel to the burner. Preferably two supply channels, one for main and one for pilot fuel, are provided in the burner shaft. Main fuel may be, for example, provided in form of a pipe, and the pilot fuel in form of an annular passage surrounding that pipe.

The invention is also directed to a method of operation of a burner as previously explained. The method comprises the steps of: (a) providing air—as oxygen containing fluid and also as a source for cooling fluid—to an exterior of the burner with a given air pressure level, such that air is guided into and guided within the annular cooling fluid passage; (b) supplying the first fuel to the burner; and (c) supplying the second fuel to the burner with a given second fuel pressure level, such that the second fuel is provided to the annular fuel passage and guided within the annular fuel passage.

Besides, the invention is also directed to a method of manufacturing a burner as previously defined, with the step of additively manufacturing the annular wall as an integrally formed component. Alternatively, the method comprises the step of additively manufacturing the upstream burner section, the intermediate burner section and the downstream burner section—altogether—as an integrally formed—i.e. single—component. Preferably the additive manufacturing steps are performed by selective laser melting or selective laser sintering, so that the component is built layer by layer and that material of the neighbouring layers are fused together to form a solid component.

Thus, the burner can be manufactured as a single piece with all features embodied in its solid walls. So, manufacturing steps are reduced. Furthermore more detailed and more complex features can be incorporated in the burner compared to traditional manufacturing methods.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

Furthermore examples have been and will be disclosed in the following sections by reference to gas turbine engines. The invention is also applicable for any type of engines that incorporate a burner.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematic. It is noted that for similar or identical elements in different figures, the same reference signs will be used.

Some of the features and especially the advantages will be explained for an assembled and operating gas turbine, but obviously the features can be applied also to the single components of the gas turbine but may show the advantages only once assembled and during operation. But when explained by means of a gas turbine during operation none of the details should be limited to a gas turbine while in operation.

In the following the problems and the proposed solution will mainly be explained for an annular combustor, but the principles may also apply to different types of combustors, like a can-annular combustor.

DETAILED DESCRIPTION OF THE INVENTION

Figure 1:
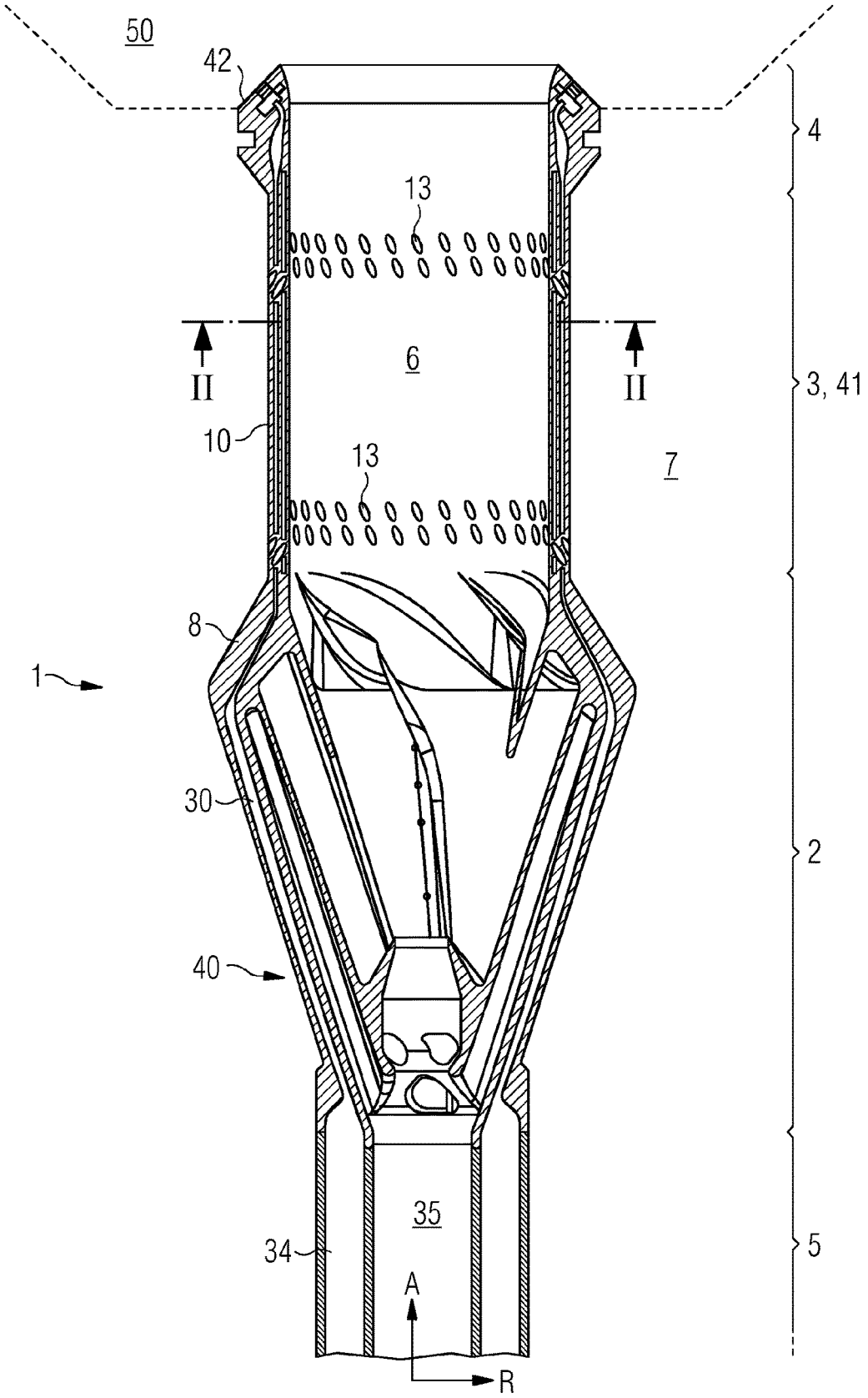
FIG. 1 schematically illustrates a cross-sectional view of an exemplary embodiment of an inventive burner.

FIG. 1 represents one exemplary burner 1 showing the inventive concept. The burner 1 is shown in a cross-sectional view and the consecutive figures may show detailed views or alternative implementation of that burner 1. This burner 1 may be part of a gas turbine engine and may be used for an annular combustor. The burner 1 may comprise an upstream burner section 2, intermediate burner section 3 and a downstream burner section 4. Upstream of the upstream burner section 2 a burner shaft 5 may be present to provide fuel to the burner 1. The upstream burner section 2 may particularly be a swirler 40 to mix fuel with air and may comprise also a transition piece that connects the swirler 40 with the intermediate burner section 3. Following in axial direction of the burner 1, the intermediate burner section 3 follows the upstream burner section 2 and provides a premixing zone 41 to further mix the previously provided air and fuel. Further downstream, the downstream burner section 4 is present and specifically provides also a burner tip 42. The upstream burner section 2, the intermediate burner section 3 and the downstream burner section 4 altogether enclose a bunter interior 6. At several locations of the burner 1 the burner interior 6 will be fluidically connected to an exterior 7 of the burner 1 via passages for passing air or cooling fluid.

As previously said, in the upstream burner section 2 the swirler 40 is present. The swirler 40 is comprised of a plurality of swirler vane 9. Each swirler vane 9 then merge in axial direction to walls of the intermediate section 3. The swirler vanes 9 and the consecutive transition section both can be defined as a body 8 of the upstream burner section 2. Incorporated in this body 8, a fuel passage for pilot fuel is included. This fuel passage—identified as fuel tube 30—will provide pilot fuel to the further downstream intermediate burner section 3.

In the example, the intermediate burner section 3 substantially is configured as a cylindrical annular wall 10. Nevertheless the annular wall 10 may also be shaped differently, as long as being annular around a space. The annular wall 10 defines along its axial length a three wall cylindrical configuration in which an annular cooling fluid passage 11 and an annular fuel passage 12 is embodied. The annular fuel passage 12 defines an annular passage for the pilot fuel provided from the upstream burner section 2.

Within the intermediate burner section 3 the annular fuel passage 12 guides the pilot fuel to the downstream section 4.

The annular cooling fluid passage 11 is supplied by cooling fluid, particularly air, from the exterior 7 of the burner 1 and guides this cooling fluid along the length of the intermediate burner section 3. The annular cooling fluid passage 11 is located radially inwards within the annular wall 10, compared to the annular fuel passage 12. That means that the annular cooling fluid passage 11 acts as a temperature shield so that the heat will not affect the annular fuel passage 12 as drastically.

Further cooling features may be present, particularly in the intermediate burner section 3. For example film cooling holes 13 may be located at different positions along the intermediate burner section 3. The film cooling holes 13 will merely pierce the annular wall 10 without merging into the annular fuel passage 12 and/or the annular cooling fluid passage 11.

Within the burner shaft 5 a first supply channel 35 for the main fuel is incorporated. Furthermore, the burner shaft 5 is configured to guide the pilot fuel via a second supply channel 35. The pilot fuel is guided from the second supply channel 34 via the fuel tube 30, which is incorporated within the swirler vanes 9, to the annular fuel passage 12 of the intermediate burner section 3. The main fuel provided from the first supply channel 35 is provided to the swirler vanes 9 for being injected into the interior 6 of the burner via fuel nozzles incorporated in the swirler vane 9.

It has to be noted though, that burners with a different geometry may inject main fuel at different spots and not only via surfaces of swirler vanes.

The burner 1 shown in FIG. 1 is substantially symmetric around an axis which is indicated by the letter A. Furthermore a radial direction is indicated in the figure by the letter R.

This burner 1 may be used in an annular combustion chamber or a can-annular combustion chamber. The combustion chamber, which is downstream of the burner 1, is highlighted in the figure in an abstract way as combustion chamber 50.

Starting from this configuration of FIG. 1 in the following figures several details of this configuration will be explained.

Figure 2:
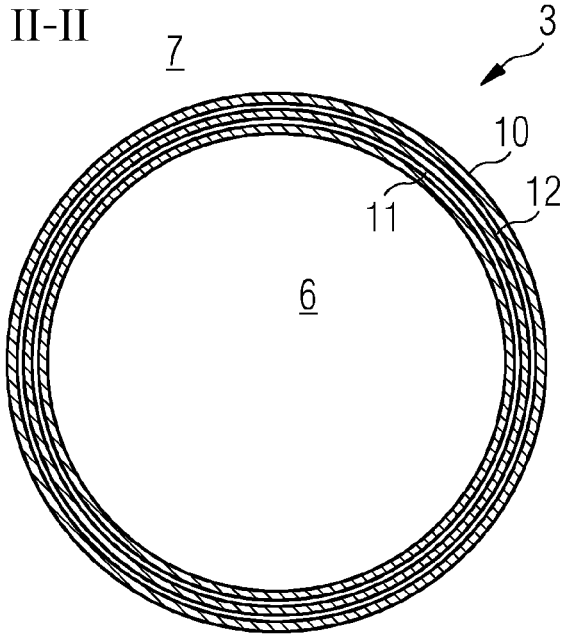
FIG. 2 illustrates a cross section of an intermediate burner section along II-II of FIG. 1.

FIG. 2 is a cross-sectional view along a line II-II which is indicated in FIG. 1. As it can be seen in FIG. 2 the annular fuel passage 12 and the annular cooling passage 11 are merely narrow slots in the annular wall 10. The annular wall 10 defines a three wall circular structure in which two slots are incorporated, the annular fuel passage 12 and the annular cooling passage 11. In one specific embodiment, in the cross-sectional view of FIG. 2, the slots are circular. In an alternative these slots may also be oval in cross sectional view.

Figure 3:
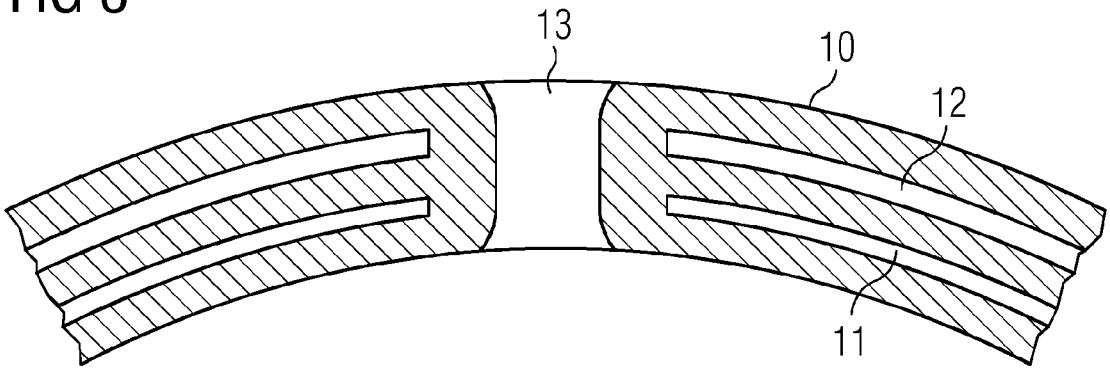
FIG. 3 shows a section of an intermediate burner section, showing an embedded film cooling hole.

FIG. 3 shows a modification of FIG. 2—and only a section of the annular wall 10 of FIG. 2—in which a film cooling hole 13 is present. Even so the film cooling hole 13 may be angled, FIG. 2 is simplified and is showing the cooling hole 13 to connect the exterior of the wall 10 with the radial inwards burner interior 6 and piercing the overall annular wall 10. The film cooling hole 13 is completely surrounded by the material of the annular wall 10 so that the film cooling hole 13 is a passage through the annular wall 10. In that region of the film cooling hole 13, the annular fuel passage 12 and the annular cooling fluid passage 11 are interrupted locally, as a boundary wall surrounds and encompasses the film cooling hole 13.

Figure 4:
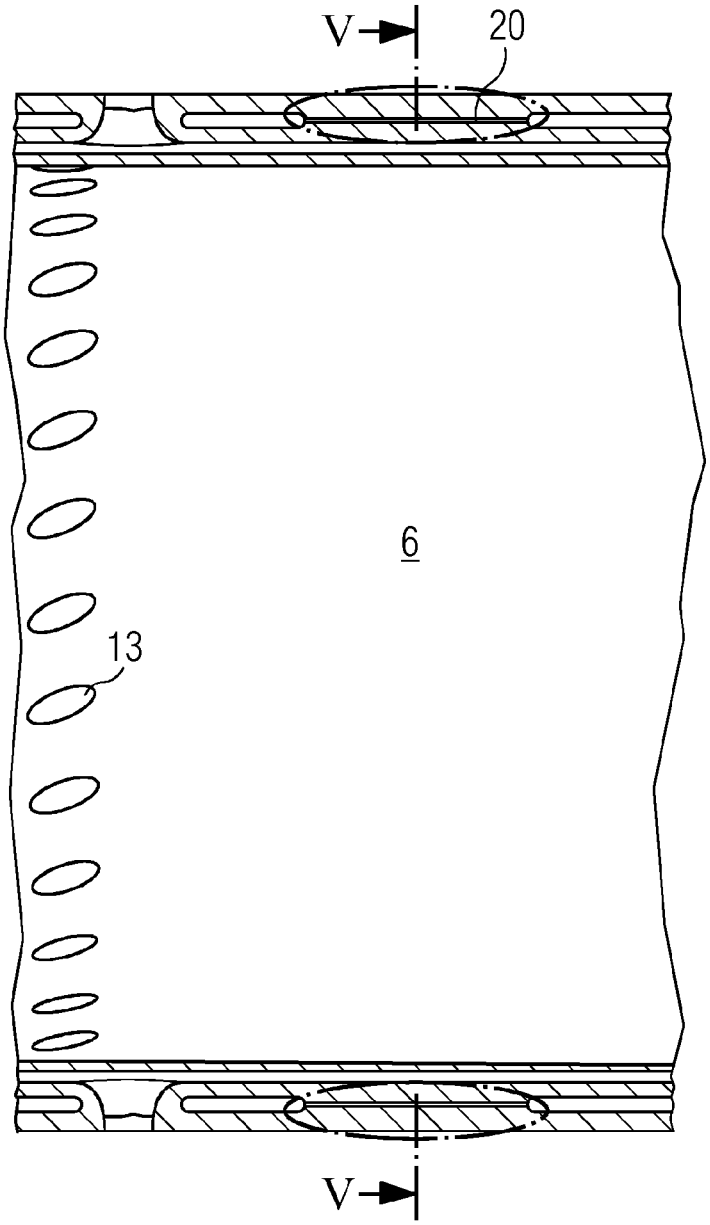
FIG. 4 schematically illustrates an alternative a intermediate burner section with incorporated spacer elements.
Figure 5:
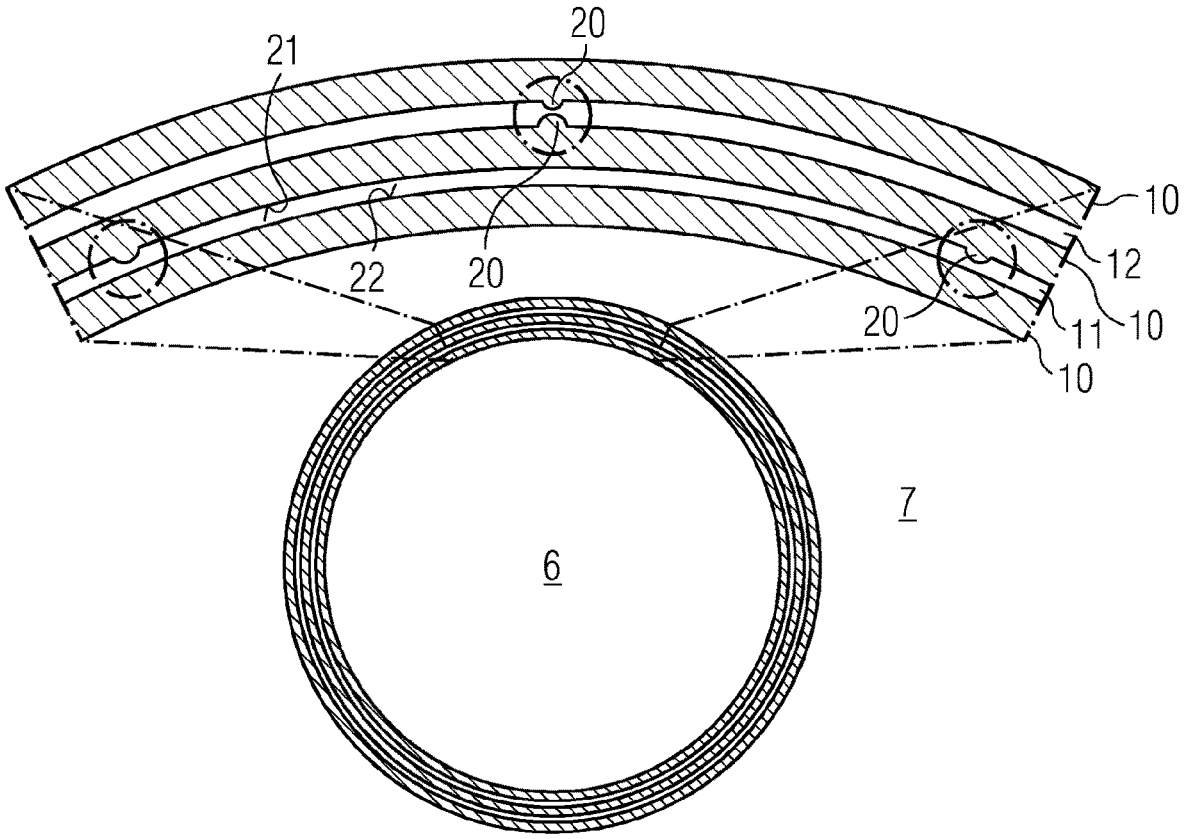
FIG. 5 illustrates a cross section of an intermediate burner section along V-V of FIG. 4.

FIG. 4 and FIG. 5 show spacer elements 20 located within the annular fuel passage 12 and/or the annular cooling fluid passage 11 in cross sectional views of the annular wall 10. The spacer elements 20 may be present for stability reasons and to keep the incorporated passages 11, 12 open. For example, as shown in FIG. 5 for the annular fuel passage 12, two spacer elements 20 may be aligned to another and will face another. Alternatively, also shown in FIG. 5 for the annular cooling fluid passage 11, a single spacer element may be present at the annular wall 10 and particularly one of the surfaces of the passages 11, 12. The spacer elements 20 may be hemispheres or semi-cylindrical components. The semi-cylindrical configuration is indicated in FIG. 4 in which the spacer elements 20 show an elongation along an axial direction.

FIG. 5 represents the same configuration as FIG. 4 and is a cross-sectional view along the line V-V of FIG. 4. What becomes clear from FIGS. 4 and 5, the spacer elements 20 are only connected to one of the surfaces of the respective passages 11, 12. Particularly the spacer elements 20 are not continued ribs or struts for joining two walls. This may be important as a heat transfer should be reduced or may become impossible via the single-sided spacer elements 20. As an example of a spacer element 20 for the annular cooling fluid passage 11 a single spacer element 20 is provided on a radial inward facing surface 21 of the annular cooling fluid passage 11. On the opposite surface, a radial outward facing surface 22 of that passage 11, no additional spacer element 20 is present.

Figure 6:
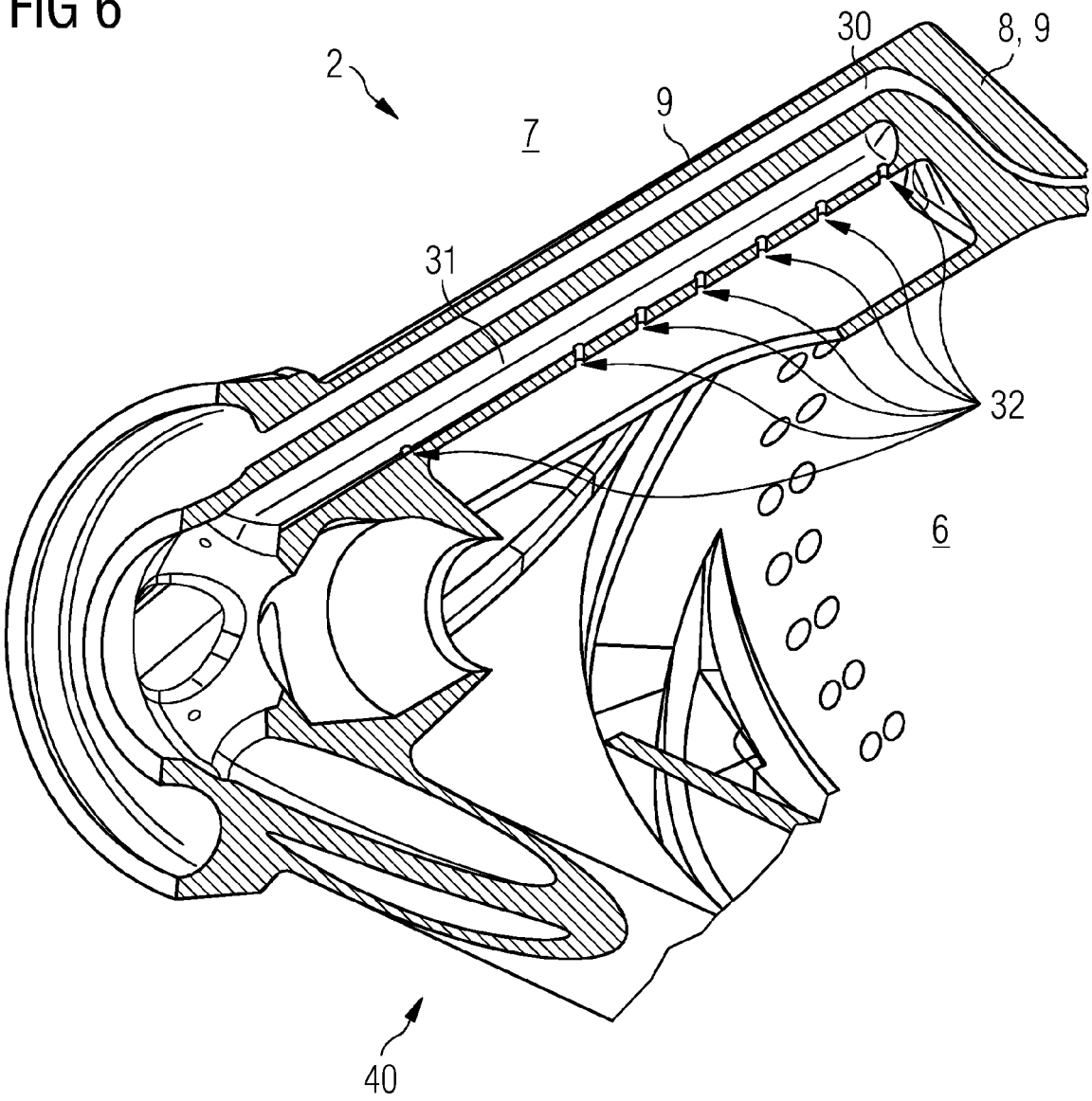
FIG. 6 shows a cross sectional view of a swirler vane showing fuel supply lines in its vanes.

FIG. 6 now shows a segment of a sectional view of the upstream burner section 2. The section is a cut through one of the swirler vanes 9. The swirler vanes 9 and a consecutive transition section are also indicated as body 8. Through the swirler vane 9 and the body 8 a fuel tube 30 is incorporated, which guides the pilot fuel to the further downstream components of the burner 1. Besides, a further fuel supply line 31 for a main fuel is also shown in this cross-sectional view. This further fuel supply line is also incorporated within the swirler vane 9. Main fuel nozzles 32 as first fuel nozzles are present on a surface of the swirler vane 9. Particularly a plurality of main fuel nozzles 32 are present. This allows to inject main fuel into passing-by air as oxygen containing fluid, which is guided between two adjacent swirler vanes 9 for further mixing and guiding into the burner interior 6.

Figure 7:
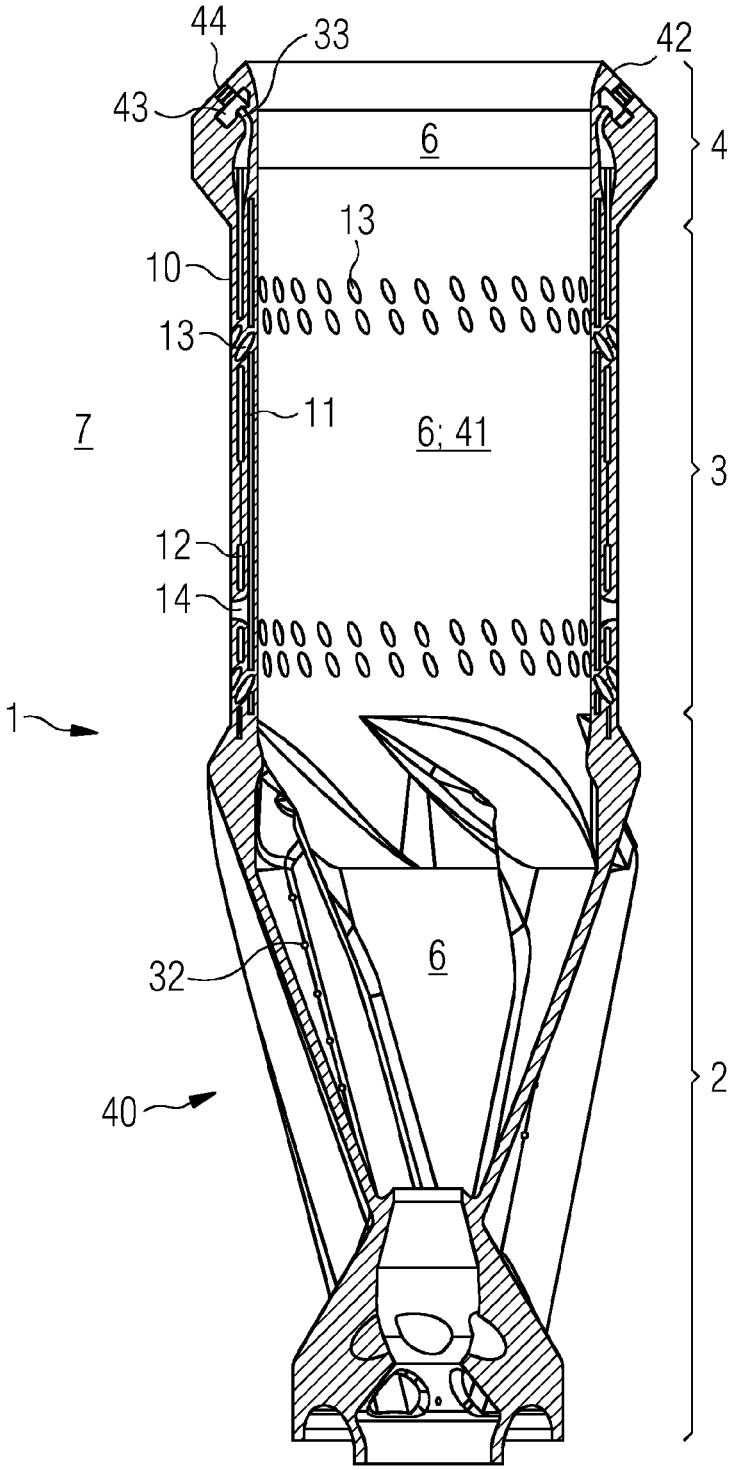
FIG. 7 schematically illustrates a cross-sectional view of a further exemplary embodiment of an inventive burner, which corresponds to FIGS. 4 and 5.

FIG. 7 now shows a further variant of the previously introduced burner 1 as introduced in FIG. 1. Again, an upstream burner section 2, an intermediate burner section 3, and a downstream burner section 4 is shown. The upstream burner section 2 again comprises a swirler 40. Also main fuel nozzles 32 are again indicated on a surface of the swirler vane 9. As before, an annular fuel passage 12 is present in the annular wall 10 of the intermediate burner section 3. As before and in accordance with the invention, the annular cooling fluid passage 11 is present radially inwards compared to the annular fuel passage 12 in respect of a burner axis.

First a specific focus is taken on the burner interior 6 in the region of the intermediate burner section 3. This area is also called the premixing zone 41. Again, film cooling holes 13 are present in the intermediate burner section 3. To provide air into the annular cooling fluid passage 11, cooling fluid inlet holes 14 are present in the annular wall 10. Only two of these cooling fluid inlet holes 14 are shown in FIG. 7 but a plurality of these cooling fluid inlet holes may be present around a circumference of the annular wall 10. The cooling fluid inlet holes 14 are fluidically connected to the annular cooling fluid passage 11. Furthermore, the cooling fluid inlet holes 14 pierces the annular wall 10 such that there is no fluidic connection to the annular fuel passage 12.

It has to noted that FIG. 7 focuses on the cooling air inlet to the annular cooling fluid passage 11 and does not show features for evacuating again this cooling fluid passage 11. This may be shown in FIG. 8 instead.

Figure 8:
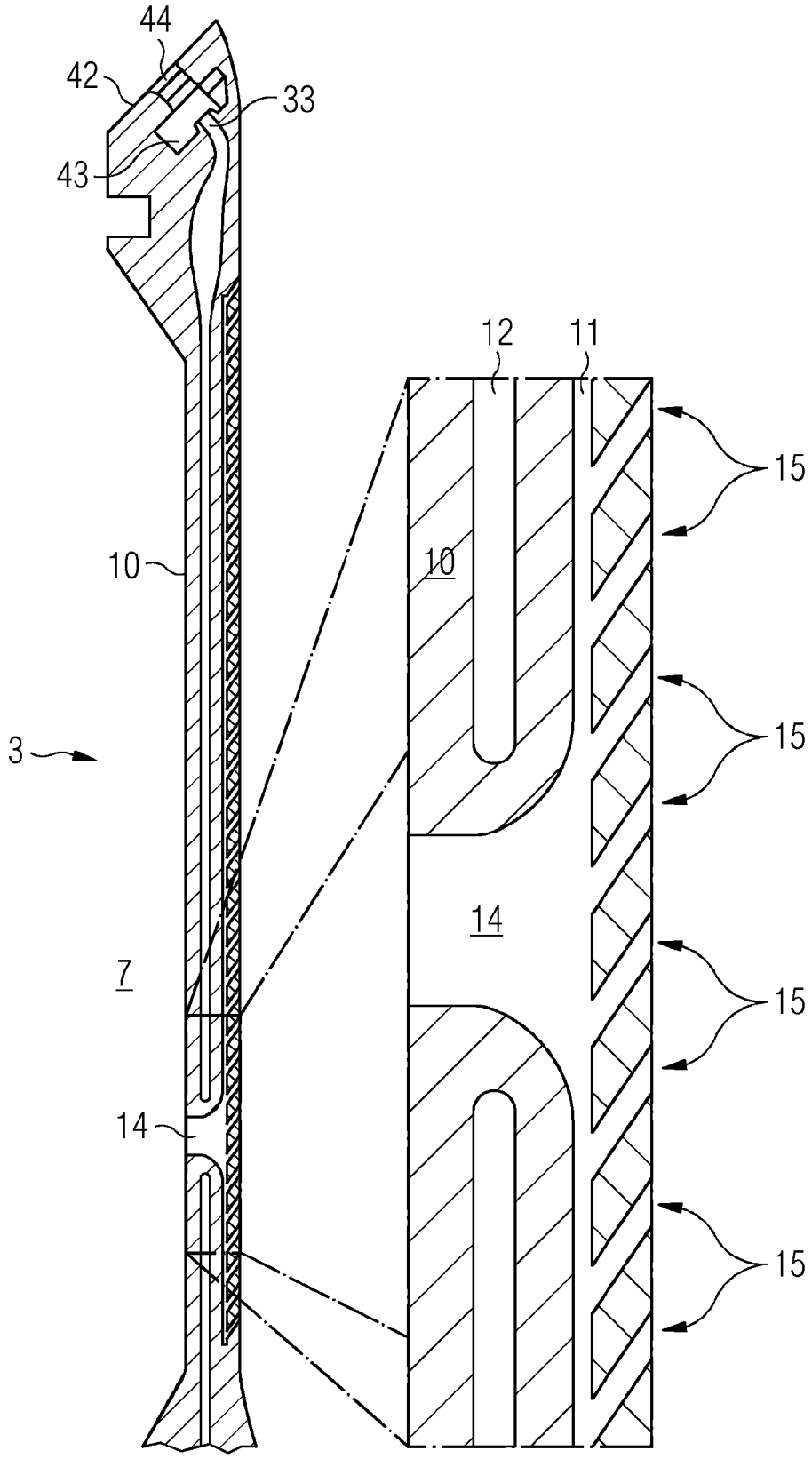
FIG. 8 shows a magnified cross-sectional view of FIG. 7, focusing on supply and ejection of cooling air to/from an annular cooling fluid passage of the burner.

FIG. 8 also shows specifically a transition from the annular fuel passage 12 to an outlet 44 on the burner tip 42. In one embodiment, not shown in FIG. 8, the annular fuel passage 12 directly merges into pilot fuel nozzle(s), which may be an annular outlet or a plurality of holes arranged on the face of the burner tip 42. Thus, in this configuration, the pilot fuel nozzles 33 are located on the face of the burner tip 42. In this configuration pure fuel is exhausted, particularly diffused, into the combustion chamber.

In a different configuration, as shown in FIG. 8, the annular fuel passage 12 allows exhaustion of pilot fuel via pilot fuel nozzles 33 into a local pre-mixing zone 43, in which pilot fuel is mixed, particularly with air, before the mixture is finally exhausted via the outlet 44 into the combustion chamber.

The air for the local pre-mixing zone 43 may be a fraction of air branched off from the annular cooling fluid passage 11 (not shown) or may be provided from separate air supply passages (not shown) leading into the local pre-mixing zone 43. The configuration with additional air for local pre-mixing can be called pilot fuel with assist air.

The pilot fluid nozzles 33 may also called second fuel nozzles in this document, as the pilot fuel may also be called second fuel.

What can be seen in FIGS. 7 and 8, the pilot fuel is guided through a wall structure along the axial length of the burner 1. Particularly the pilot fuel is guided within swirler vanes 9, the annular wall 10 of the intermediate burner section 3 and within a wall of the downstream burner section 4 which ends in a tip region 42 of the burner 1 for ejection of the pilot fuel into the combustion chamber.

FIG. 8 also shows this pilot fuel passage system with focus on the annular wall 10 and the downstream burner section 4. Additionally, a main focus of FIG. 8 is the ejection of air from the annular cooling fluid passage 11. Air provided via the cooling fluid inlet hole 14 is distributed in the annular cooling fluid passage 11 and may be exhausted via numerous effusion holes 15. The effusion holes may provide effusion cooling of the interior of the annular wall 10. For this, the effusion holes 15 may be distributed along an axial length of the annular wall 10. Furthermore the effusion holes 15 may also be distributed around a circumference of the annular wall 10. Therefore an expanded surface region can be provided with effusion cooling in the region of the intermediate burner section 3.

All these embodiments show several advantages which now will be summarized in the following. The burner 1 shows a simplified geometry which is possible to be manufactured by additive manufacturing technology, for example selective laser melting or selective laser sintering. By this, fuel and air passages can be incorporated into a load carrying structure of the burner. Pilot fuel feeding can then be incorporated inside the swirler and the mixing tube instead of having a separate pilot supply line at the exterior of the burner. In consequence the air flow of air in the surrounding of the burner will not be disturbed anymore by an exterior fuel pipe. So the air will be undisturbed and a better well-defined airflow into the burner is achieved. The integrated pilot fuel passage—the annular fuel passage 12—is easy to adjust in size, if needed, to accommodate a specific fuel specification. Besides, the annular wall configuration by having an annular fuel passage 12 allows a more even distribution of pilot fuel around the circumference at the burner tip 42. Furthermore, this new design allows reducing the number of components that otherwise would be needed for assembly of the burner and by that also the number of welding steps and manufacturing operations are decreased.

The integrated annular cooling fluid passage 11 acts as a thermal shield for heat affecting otherwise the annular fuel passage 12. Therefore it counteracts coking in case of liquid fuel.

The integrated pilot fuel feeding via the annular fuel passage 12 and the corresponding components enables possibilities for fuel flexibility, for example high to low calorific fuels.

The even flow of the pilot fuel injection will eventually also improve emissions, as the conditions for combustion are also improved by the integrated pilot fuel within the annular wall 10. Besides, the improved distribution at the burner tip 42 also results in a better condition for combustion and allows possibilities for improved emissions.

If film cooling holes 13 or spacer elements 20 are present within the annular wall 10 these additionally can act as turbulators for the annular fuel passage 12 which in consequence helps to even out the pilot fuel flow within the annular fuel passage 12.

The spacer elements 20 can be considered as distance bumps to secure a minimum slot height and to even provide varying slot heights within the annular fuel passage 12 or the annular cooling fluid passage 11.

Due to the improved cooling functionality due to the effusion holes 15, this configuration reduces the likelihood of coking and reduces also the risk of flame back within the intermediate burner section 3. A protection of the fuel pipe, the annular fuel passage 12, is obtained by the most inner concentric cylinder, separated via the annular cooling fluid passage 11. The most inner concentric cylinder may be equipped the effusion holes in a pattern distributed around the surface which eventually will prevent coking of the mixing wall at liquid fuel operation and also act as protection for overheating of the fuel feeding structure.

The invention provides heat load protection at flame back of the fuel feeding structure by the inner cylinder and the cooperating air slot of the annular cooling fluid passage 11. The protection can be enhanced by the effusion holes in the inner cylinder wall. Coking is prevented also by the effusion hole distribution in the inner cylinder wall. Further advantages may become apparent dependent on the geometry of the burner 1.

According to FIGS. 1 to 8 an exemplary burner for an annular combustor was discussed. That exemplary burner was configured as the following, which was previously possibly not defined in full detail: The burner includes a burner head, a burner interior, a swirler, and a premixing section. The burner head includes a burner head end. The swirler is arranged in series between the burner head and the premixing section. The burner 1 has a main axis. The burner head, the swirler and the premixing section are arranged along the main axis. The swirler according to the figures is an elongated three-dimensional body. The swirler is open at both ends and has a side wall enclosing a volume or limiting a volume within the side wall and the open ends. Similarly, the premixing section is an elongated three-dimensional body. The premixing section is open at both ends and has a side wall enclosing a volume or limiting a volume within the side wall and the open ends. The volume enclosed by swirler and the volume enclosed by the premixing section together form a volume referred to as the burner interior. As shown in FIG. 1, the swirler may be conically designed for example having a conical frustum shape. The conical frustum shape of the swirler has a top side and a bottom side. A cross-sectional area of the bottom side is greater than a cross-sectional area of the top side, or in other words, a cross-section of the conical frustum increases from the top side towards the bottom side along the main axis. The top side is connected to the burner head end of the burner head and the bottom side is connected to the pre-mixing section. The swirler includes an inlet section. The inlet section is fluidly connected to the compressor (not shown) of the turbomachine (not shown). The inlet section receives compressed air from the compressor and introduces the compressed air into the burner interior, more precisely into the upstream side of the burner interior. Similarly, the inlet section is fluidly connected to a fuel supply (not shown) of the turbomachine. The inlet section receives main gas fuel from the fuel supply and introduces the main gas fuel into the burner interior, more precisely into the upstream side of the burner interior. The inlet section of the swirler includes at least one air inlet and at least one main fuel gas inlet. The compressed air is introduced into the burner interior via the air inlet and the main gas fuel is introduced into the burner interior via the main fuel gas inlet. The air inlet may be tangentially arranged along the swirler with respect to the main axis. Similarly, the main fuel gas inlet may be tangentially arranged along the swirler with respect to the main axis. For example, when the swirler is conical frustum shaped, the air inlet and/or the main fuel gas inlet may be formed as longitudinally extending slots through a body wall (now shown) of the conical frustum. In an exemplary embodiment of the burner, the inlet section includes a plurality of the air inlets and a plurality of the main fuel gas inlets arranged around the swirler in a distributed way such that when the main gas fuel and the compressed air enter the burner interior though the air inlets and the main fuel gas inlets, a swirl is generated in the compressed air and the main gas fuel.

The basic technique in such dual fuel combustor is to premix the main fuel with air from a compressor of the turbomachine before igniting the combustion mixture, i.e. mixture of the air from the compressor and the main fuel, in the combustion chamber. Usually the air from the compressor is mixed with the main gaseous fuel, either inside the swirler or just before introduction into the swirler, and then swirled by the swirler to create a swirling flow of the air and the main gaseous fuel. This swirling flow of the pressurized air from the compressor and the main gaseous fuel then enters from the swirler into the premixing section. At the premixing section the pressurized air from the compressor and the main gaseous fuel are allowed to mix well before exiting into the combustion chamber or the combustion space where the combustion mixture undergoes combustion.

In dual fuel combustors, the main fuel—liquid or gaseous fuel—is discharged by a nozzle positioned at the burner head or at the swirler vanes. The main fuel after exiting the nozzle, advantageously in atomized form if liquid fuel is used, enters the swirler and then continues into the premixing section and finally into the combustion chamber where the main fuel participates in the combustion reaction.

Figure 9:
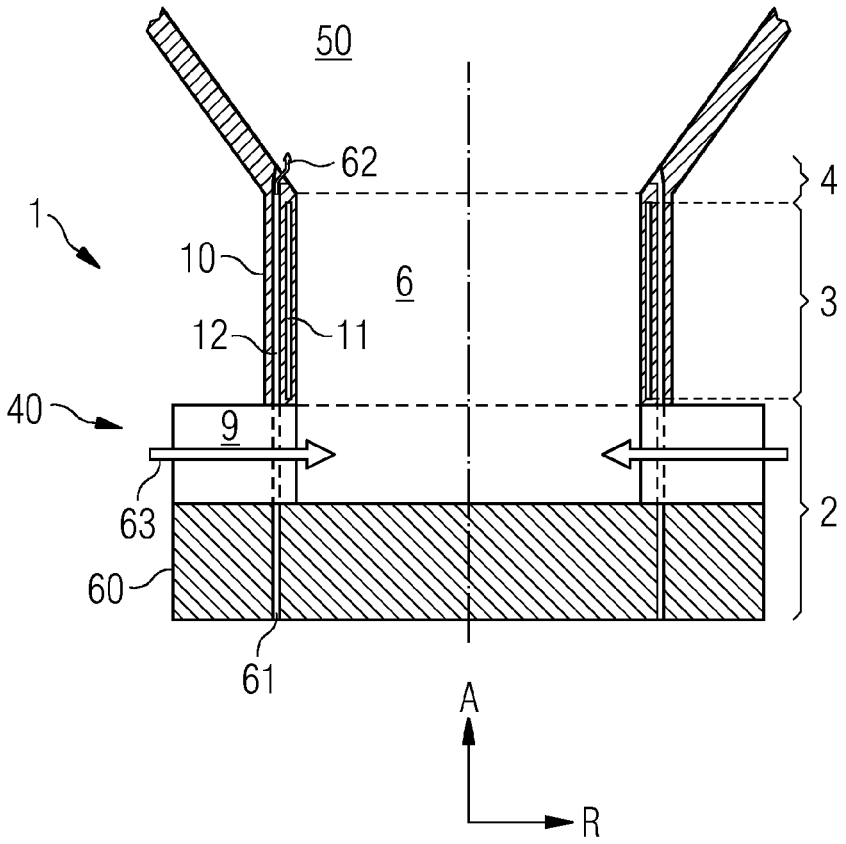
FIG. 9 shows a cross sectional view of an alternative burner illustrating an annular wall with incorporated annular slots.

Just to briefly explain that the invention can also be used in different burner design, in FIG. 9 an alternative burner design is shown. Same reference numerals are used if similar components are to be identified than before.

According to FIG. 9 a combustor is shown, in which a burner 1 is shown, connected to a combustion chamber 50. An upstream burner section 2 comprises burner head 60, a radial swirler 40 comprising a plurality of swirler vanes 9, followed by an intermediate burner section 3. Downstream, the intermediate burner section 3 is connected to the combustion chamber 50 via a downstream burner section 4.

The intermediate burner section 3 comprises an annular wall 10, which encompasses an annular cooling fluid passage 11 and an annular fuel passage 12. Inlet and outlet to the annular cooling fluid passage 11 is not shown. A fuel inlet 61 to feed the annular fuel passage 12 is given as an example through the burner head 60 and piercing the solid portion of the swirler vanes 9, so that the fuel inlet 61 can be connected to the annular fuel passage 12. At a downstream end of the annular fuel passage 12, the pilot fuel is ejected into the combustion chamber 50, as indicated by arrow 62.

The radial swirler 40 is present to guide air, indicated by arrow 63, to swirl the air and to guide it to the burner interior 6. Typically at the swirler vanes 9, it will also be mixed with main fuel (not indicated in the figure).

In consequence, the annular wall 10 shown in FIG. 9 can also be provided with the inventive three cylindrical wall structure, with embedded slots for pilot fuel and air.

This was one example for an alternative burner design. Other burner designs, can also be equipped with the inventive features.

While the present technique has been described in detail with reference to certain embodiments, it should be appreciated that the present technique is not limited to those precise embodiments. Rather, in view of the present disclosure which describes exemplary modes for practicing the invention, many modifications and variations would present themselves, to those skilled in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A burner of a turbomachine or a gas turbine engine, comprising:

an upstream burner section for providing a first fuel and an oxygen containing fluid to an upstream end of a burner interior, wherein the burner interior is substantially a hollow space in which a mixing of the first fuel and the oxygen containing fluid takes place;

a downstream burner section for providing a second fuel to a downstream end of the burner interior; and an intermediate burner section between the upstream burner section and the downstream burner section; wherein the intermediate burner section comprises an annular wall comprising a radially inner surface that defines a mid section of the burner interior and a radially outer surface, the annular wall comprising:

an annular cooling fluid passage between the radially inner surface and the radially outer surface; and an annular fuel passage for guiding the second fuel to the downstream burner section, the annular fuel passage surrounding and extending substantially parallel to the annular cooling passage along a length of the intermediate burner section and being disposed between the annular cooling fluid passage and the radially outer surface and thereby being more distant to the burner interior than the annular cooling fluid passage, and wherein the upstream burner section comprises at least one integrated fuel tube through a body of the upstream burner section, that is configured to feed the annular fuel passage.

2. The burner according to claim 1, wherein the annular wall further comprises a plurality of film cooling holes that pierce the annular wall from an exterior of the burner to the mid section of the burner interior, the plurality of film cooling holes piercing the annular cooling fluid passage and piercing the annular fuel passage but being fluidically separate from the annular cooling fluid passage and from the annular fuel passage.

3. The burner according to claim 1, wherein the annular wall further comprises at least one cooling fluid inlet hole providing the annular cooling fluid passage with cooling fluid from an exterior of the burner, the at least one cooling fluid inlet hole piercing the annular fuel passage but being fluidically separate from the annular fuel passage.

4. The burner according to claim 1, wherein the annular wall further comprises a plurality of effusion holes for ejecting cooling fluid from the annular cooling fluid passage to the mid section of the burner interior.

5. The burner according to claim 4, wherein the plurality of effusion holes are distributed around a circumference and along an axial length of the intermediate burner section.

6. The burner according to claim 1, wherein the annular wall further comprises spacer elements within the annular cooling fluid passage and/or the annular fuel passage, wherein the spacer elements are physically connected to one surface and only in loose contact with an opposite surface of the respective annular passage.

7. The burner according to claim 1, wherein the annular wall is an integrally formed component, joined with the upstream burner section and the downstream burner section, or wherein the upstream burner section, the intermediate burner section and the downstream burner section are an integrally formed component.

8. The burner according to claim 1, wherein the annular cooling fluid passage and the annular fuel passage each are defined as a slot with an expansion along a complete axial length of the intermediate burner section.

9. The burner according to claim 1, wherein the upstream burner section comprises a plurality of swirler vanes, each swirler vane of the plurality of swirler vanes providing a portion of the at least one integrated fuel tube, that is configured to feed the annular fuel passage.

10. The burner according to claim 9, wherein each swirler vane of the plurality of swirler vanes comprises an integrated further fuel supply line, wherein the integrated further fuel supply line feeds first fuel nozzles to eject the first fuel into the upstream end of the burner interior.

11. The burner according to claim 10, wherein the first fuel nozzles are distributed on a respective surface of each swirler vane of the plurality of swirler vanes.

12. The burner according to claim 1, wherein the upstream burner section provides a swirler and first fuel nozzles for swirling the oxygen containing fluid and injecting the first fuel into the swirled oxygen containing fluid, wherein the intermediate burner section provides a pre-mixing zone for mixing the swirled oxygen containing fluid and the injected first fuel, and wherein the downstream burner section provides a burner tip and second fuel nozzles for ejecting the second fuel.

13. The burner according to claim 1, wherein of the mid section of the burner interior is substantially cylindrical.

14. The burner according to claim 1, wherein the annular cooling fluid passage guides the oxygen containing fluid.

15. A combustor, comprising: a plurality of burners, at least one burner of the plurality of burners arranged according to claim 1; and at least one combustion chamber arranged downstream of the at least one burner.

16. The combustor according to claim 15, wherein a burner shaft is attached to the upstream burner section and comprises at least one supply channel for providing the first fuel and/or the second fuel to the at least one burner.

17. The combustor according to claim 15, wherein the at least one combustion chamber is an annular or a can-annular combustion chamber arranged downstream of the at least one burner.

18. A burner of a turbomachine or a gas turbine engine, comprising:

an upstream burner section for providing a first fuel and an oxygen containing fluid to an upstream end of a burner interior, wherein the burner interior is substantially a hollow space in which a mixing of the first fuel and the oxygen containing fluid takes place;

a downstream burner section for providing a second fuel to a downstream end of the burner interior or to a combustion chamber; and an intermediate burner section between the upstream burner section and the downstream burner section;

wherein the intermediate burner section comprises an annular wall surrounding a mid section of the burner interior, the annular wall comprising:

an annular cooling fluid passage; and an annular fuel passage for guiding the second fuel to the downstream burner section, the annular fuel passage being more distant to the burner interior than the annular cooling fluid passage, wherein the upstream burner section comprises at least one integrated fuel tube through a body of the upstream burner section, that is configured to feed the annular fuel passage, and wherein the annular wall further comprises a plurality of film cooling holes that pierce the annular wall from an exterior of the burner to the mid section of the burner interior, the plurality of film cooling holes piercing the annular cooling fluid passage and piercing the annular fuel passage but being fluidically separate from the annular cooling fluid passage and from the annular fuel passage.

19. A burner of a turbomachine or a gas turbine engine, comprising:

an upstream burner section for providing a first fuel and an oxygen containing fluid to an upstream end of a burner interior, wherein the burner interior is substantially a hollow space in which a mixing of the first fuel and the oxygen containing fluid takes place;

a downstream burner section for providing a second fuel to a downstream end of the burner interior or to a combustion chamber; and an intermediate burner section between the upstream burner section and the downstream burner section;

wherein the intermediate burner section comprises an annular wall surrounding a mid section of the burner interior, the annular wall comprising:

an annular cooling fluid passage; and an annular fuel passage for guiding the second fuel to the downstream burner section, the annular fuel passage being more distant to the burner interior than the annular cooling fluid passage, wherein the upstream burner section comprises at least one integrated fuel tube through a body of the upstream burner section, that is configured to feed the annular fuel passage, and wherein the annular wall further comprises at least one cooling fluid inlet hole providing the annular cooling fluid passage with cooling fluid from an exterior of the burner, the at least one cooling fluid inlet hole piercing the annular fuel passage but being fluidically separate from the annular fuel passage.

* * * * *